US006202611B1

(12) United States Patent
Regueiro

(10) Patent No.: US 6,202,611 B1
(45) Date of Patent: Mar. 20, 2001

(54) CAMSHAFT DRIVE DEVICE FOR AN INTERNAL COMBUSTION ENGINE

(75) Inventor: Jose F Regueiro, Rochester Hills, MI (US)

(73) Assignee: DaimlerChrysler Corporation, Auburn Hills, MI (US)

( * ) Notice: Subject to any disclaimer, the term of this patent is extended or adjusted under 35 U.S.C. 154(b) by 0 days.

(21) Appl. No.: 09/471,899

(22) Filed: Dec. 23, 1999

(51) Int. Cl.[7] ..... F01L 1/344

(52) U.S. Cl. ..... 123/90.17; 123/90.31; 74/568 R; 464/2; 464/160

(58) Field of Search ..... 123/90.15, 90.17, 123/90.31; 74/568 R; 464/1, 2, 160, 161

(56) References Cited

U.S. PATENT DOCUMENTS

| | | | | |
|---|---|---|---|---|
| 4,463,712 | | 8/1984 | Stojek et al. . | |
| 4,561,390 | | 12/1985 | Nakamura et al. . | |
| 4,986,801 | | 1/1991 | Ohlendorf et al. . | |
| 5,111,780 | | 5/1992 | Hannibal . | |
| 5,211,141 | * | 5/1993 | Hannibal et al. | 123/90.17 |
| 5,219,313 | * | 6/1993 | Danieli | 464/2 |
| 5,355,849 | | 10/1994 | Schiattino . | |
| 5,542,383 | | 8/1996 | Clarke et al. . | |
| 5,673,659 | | 10/1997 | Regueiro . | |
| 5,680,837 | | 10/1997 | Pierik . | |
| 5,687,681 | | 11/1997 | Hara . | |
| 5,803,030 | * | 9/1998 | Cole | 123/90.17 |
| 5,860,328 | * | 1/1999 | Regueiro | 74/568 R |
| 5,862,783 | * | 1/1999 | Lewis | 123/90.17 |
| 5,979,382 | * | 11/1999 | Heer | 123/90.17 |

* cited by examiner

*Primary Examiner*—Weilun Lo
(74) *Attorney, Agent, or Firm*—Kenneth H. Maclean

(57) ABSTRACT

A camshaft drive that is provided with a timing drive assembly at the front end of an internal combustion engine and a control assembly at the rear end of the engine characterized in that a portion of the control assembly is capable of being a self-contained unit which is easily mounted to the cylinder head of the engine through a simple attachment arrangement.

13 Claims, 4 Drawing Sheets

CAMSHAFT DRIVE DEVICE FOR AN INTERNAL COMBUSTION ENGINE

FIELD OF INVENTION

This invention relates to a valve train of an internal combustion engine and, more particularly, concerns a device for varying the timing of the opening and closing of the intake and/or exhaust valves with respect to the phase of the piston stroke.

BACKGROUND OF THE INVENTION

A large number of variable valve timing mechanisms have been proposed in the prior art for use in internal combustion engines and certain of such engines presently being manufactured have been equipped with mechanisms of this type. Some of the variable valve timing mechanisms that I have proposed for use in internal combustion engines are disclosed in the following U.S. patents and patent applications:

- U.S. Pat. No. 5,673,659 entitled "LEAD SCREW DRIVEN SHAFT PHASE CONTROL MECHANISM", issued on Oct. 7, 1997.
- U.S. Pat. No. 5,860,328 entitled "SHAFT PHASE CONTROL MECHANISM WITH AN AXIALLY SHIFTABLE SPLINED MEMBER", issued on Jan. 19, 1999.
- U.S. patent application Ser. No. 09/283,019, entitled "TWO PART VARIABLE VALVE TIMING DEVICE", filed on Apr. 1, 1999.
- U.S. patent application Ser. No. 09/384,680 entitled "PHASE CHANGING DEVICE" filed on Aug. 27, 1999.
- U.S. patent application Ser. No. 09/384,804 entitled "CAMSHAFT PHASE CONTROLLING DEVICE" filed on Aug. 27, 1999.

One characteristic of each of the mechanisms disclosed in the above-mentioned patents and patent applications is that they are all intended to be custom-made for the engines, i.e., integrally designed as part of the cylinder head and valve train mechanism of the engine. This approach can be expensive because the mechanism normally does not lend itself well for use across-the-board on different engines. In other words, there is no total unit interchangeability and, therefore, no cost reduction based on very large production volumes. This is true especially in cases where the mechanism is only being used on low volume top-of-the-line car models. The cost can also be increased if the mechanism is incorporated into the cylinder head and the valve train as the cylinder head is assembled on the engine. As new internal combustion engines are designed with variable valve timing devices, it is important to produce identical low-cost variable valve timing mechanisms suitable for uses on a variety of engines. With the possibility of large volumes, it would be possible to lower costs by designing better variable valve timing mechanisms with improved materials and higher durability.

Each of my patent applications identified above as items 3–5, disclose variable valve timing mechanisms that utilize a novel method of replacing splines by low-friction, low-wear encapsulated ball splines to angularly index the camshaft in relation to the camshaft drive gear. Another difference in these mechanisms, as compared to the prior art hydraulically operated mechanisms, is that the operational force is provided both ways by electrically driven stepper motors. In addition, the above patent applications also disclose a novel method of axially moving a shifting sleeve by using a low friction encapsulated ball lead screw as a linear motion device.

SUMMARY OF THE INVENTION

The present invention concerns a camshaft drive device that incorporates some of the features of my earlier patented and patent application designs. Also, the present invention provides a simple, compact, sturdy, low friction, low cost, self contained, and universal variable valve timing device for an internal combustion engine. By so doing, the device is usable on different engines, so long as such engines satisfy the proper standardized mounting requirements.

In the preferred form, the camshaft drive device according to the present invention has a portion thereof adapted for special mounting onto the rear end of an internal combustion engine having the usual crankshaft. More specifically, the camshaft drive device comprises a timing drive assembly located at the forward end of the engine and a control assembly located at the rear end of the engine. The timing drive assembly has a drive gear adapted to be driven by the crankshaft of the engine and a hollow camshaft extends between the timing drive assembly and the control assembly. A quill shaft is co-axially mounted within the hollow camshaft and has a first portion located at the front end of the engine that is connected to the drive gear. The quill shaft has a second portion located at the rear end of the engine that is formed with a plurality of hemispherical cavities located in a plane extending transversely to the longitudinal axis of the quill shaft. Each of the hemispherical cavities of the quill shaft accommodate a ball. The hollow camshaft is rigidly connected to a cylindrical extension member encircling the second portion of the quill shaft and has its inner cylindrical surface formed with straight splines extending along the longitudinal axis of the hollow camshaft. The control assembly also includes an axially movable sleeve member which is connected with a cylindrical connector member located between the balls supported by the quill shaft and the straight splines of the cylindrical extension member. The cylindrical connector member has the outer surface thereof supporting a plurality of circumferentially spaced balls which mate with the straight splines of the cylindrical extension member and has its inner surface formed with helical splines which mate with the balls of the quill shaft. A nut member surrounds the sleeve member and is drivingly connected to the sleeve member through a plurality of circumferentially spaced non-recirculating balls encapsulated in the sleeve member and located in a helical groove formed in the nut member. The arrangement is such that, upon rotation of the nut member, the sleeve member and the cylindrical connector member are moved axially to cause the helical splines of the cylindrical connector member, acting through the straight splines of the cylindrical extension member, to provide a phase change of the camshaft relative to the drive gear.

One object of the present invention is to provide a new and improved camshaft drive device that is provided with a timing drive assembly at the front end of an internal combustion engine and a control assembly at the rear end of the engine characterized in that a portion of the control assembly is capable of being a self-contained unit which can be easily mounted to the cylinder head of the engine through a snap-action attachment arrangement.

Another object of the present invention is to provide a new and improved camshaft drive device that includes an electromechanical actuator for indexing the cams of the exhaust camshaft or intake camshaft and in which an encapsulated ball-nut-lead-screw type subsystem is used to affect shifting motion between two sets of splines.

A further object of the present invention is to provide a new and improved camshaft drive device incorporating a non-recirculating ball-nut transmission for linearly moving a sleeve member and in which balls are encapsulated in hemispherical cavities formed in the sleeve member which is surrounded by a nut member having a helical groove for cooperating with the balls and providing axial movement of the sleeve member and, through straight splines at one end of the quill shaft and a connecting member provided with a plurality of balls located in a transverse plane and attached to the sleeve member, serves to interconnect the straight splines with the helical grooves for angularly repositioning the camshaft relative to an engine-driven drive gear of the timing gear assembly.

BRIEF DESCRIPTION OF THE DRAWINGS

Other objects and advantages of the present invention will be more apparent from the following detailed description of the invention when taken with the drawings in which.

DETAILED DESCRIPTION OF THE INVENTION

Figure 1:
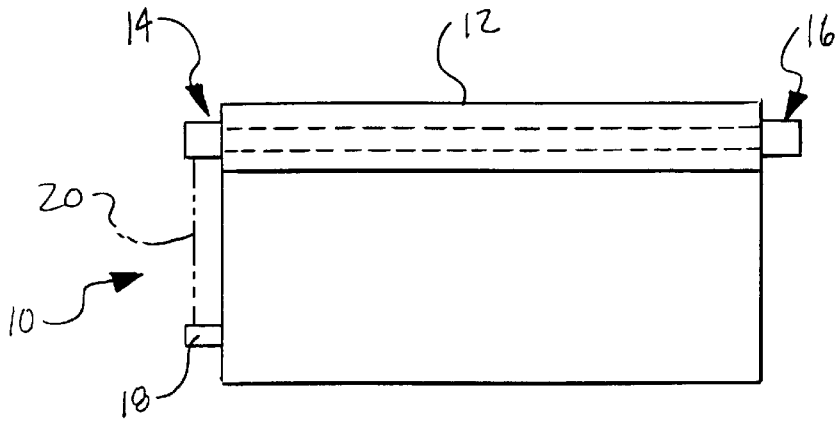
FIG. 1 is a schematic representation of the camshaft drive device according to the present invention combined with an internal combustion engine with the timing drive assembly of the device located at the front end of the engine and connected to the crankshaft of the engine and with the control assembly located at the rear of the engine.

Referring to the drawings and more particularly to FIG. 1 thereof, an in-line internal combustion engine 10 is shown schematically in block form as being equipped with a camshaft drive device made in accordance with the present invention. The camshaft drive device shown is intended to be incorporated with the intake camshaft that operates a number of intake valves (not shown) disposed in the cylinder head 12 of the engine 10. It will be understood that a similar camshaft drive device can control the exhaust camshaft of the engine 10.

Figure 2:
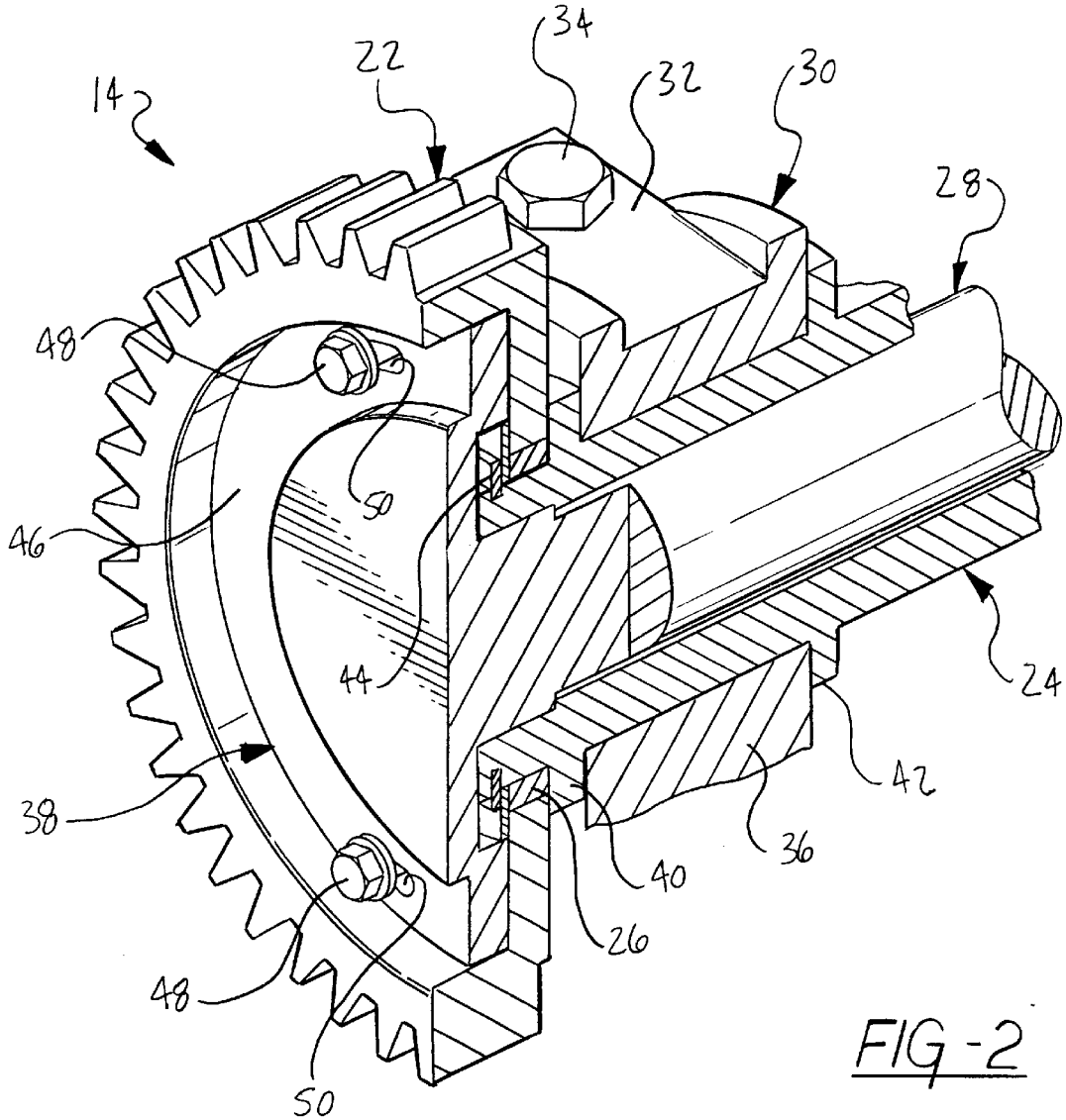
FIG. 2 is an isometric view with parts broken away and with some parts in section so as to show the various parts of the timing drive assembly of the camshaft drive device according to the present invention.
Figure 3:
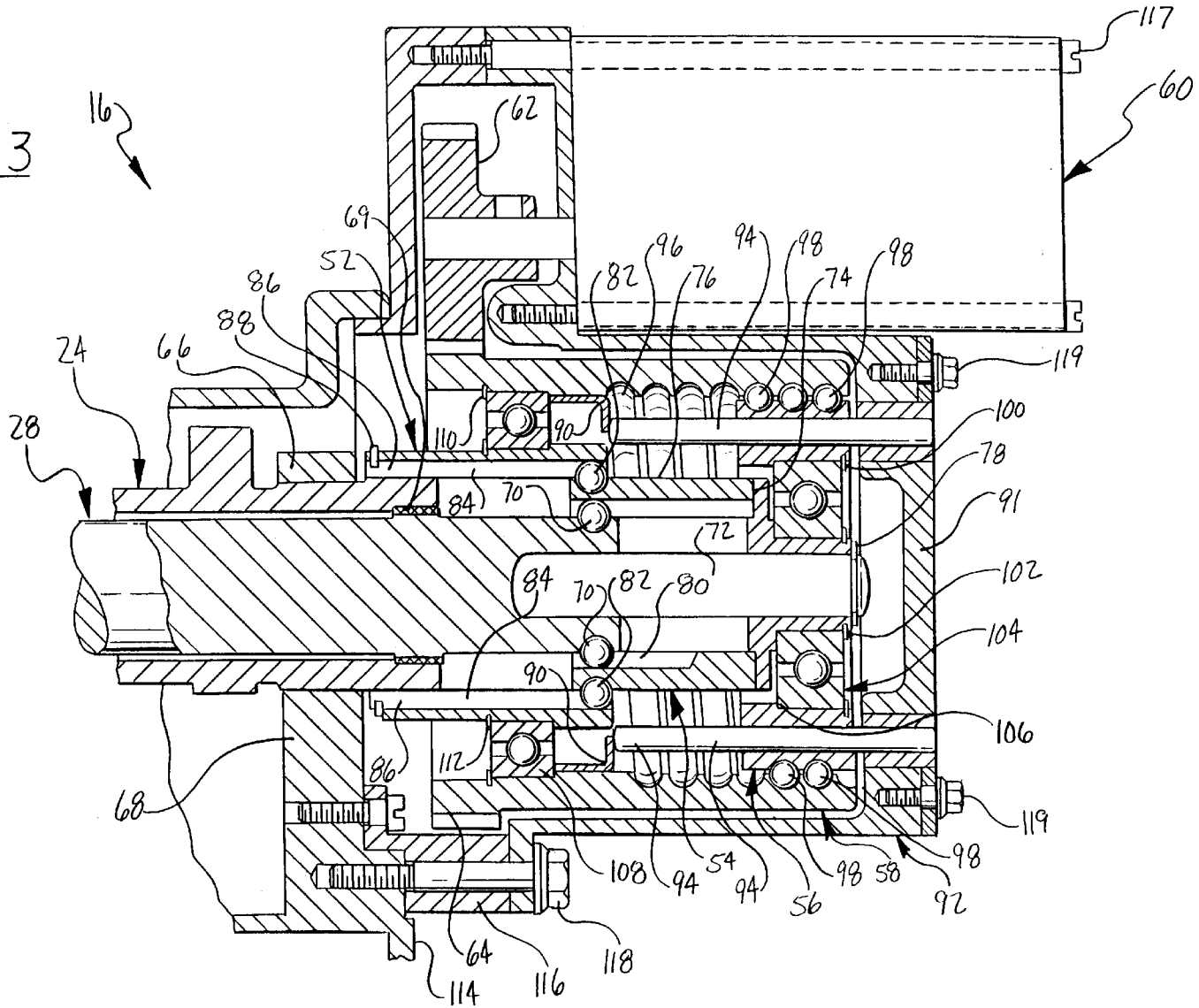
FIG. 3 is a cross-sectional view showing the internal parts of the control assembly which is a part of the camshaft drive device according to the present invention.

The camshaft drive device includes a timing drive assembly 14, as shown in FIG. 2, that is mounted at the front end of the engine 10 and a control assembly 16, as seen in FIG. 3, mounted at the rear of the engine 10. One reason for locating the control assembly in the rear of the engine 10 is that in transverse engine installations, there is little space at the front timing-end of the engine, but more space at the rear end of the engine over the transaxle. Accordingly, by dividing the camshaft drive device into two parts, the space available under the hood of an automobile is more efficiently utilized.

The crankshaft 18 of the engine 10 is drivingly connected to the timing drive assembly 14 through a gearing arrangement 20 depicted, in this instance, by the dotted lines extending between the timing drive assembly 14 and the crankshaft 18. Alternatively, rather than having a direct gearing arrangement for providing drive to the timing drive assembly 14, a chain or belt drive can be used for this purpose in which case one sprocket would be connected to the crankshaft 18 and another sprocket would be a part of the timing drive assembly 14. In either case, the drive provided to the timing drive assembly 14 would be a 2:1 speed ratio.

As seen in FIG. 2, the timing drive assembly 14 includes a drive gear 22 which is operatively associated with the front portion of a hollow camshaft 24, the rear portion of which is operatively associated with the control assembly 16 seen in FIG. 3. A bearing sleeve 26 is interposed between the drive gear 22 and the front portion of the camshaft 24. An elongated and cylindrical quill shaft 28 extends through the hollow camshaft 24 and, in effect, interconnects the timing drive assembly 14 with the control assembly 16.

More specifically and as seen in FIG. 2, the front portion of the timing drive assembly 14 together with the camshaft 24 is supported for rotation by a bearing assembly 30 which includes a semi-cylindrical bearing cap 32 secured by bolts 34 (only one shown) to a bearing saddle 36 integrally formed as part of the cylinder head 12 of the engine 10. In general, the timing drive assembly 14 comprises the drive gear 22, a hub member 38 integrally formed with the front end of the quill shaft 28, and the front portion of the camshaft 24 all of which are interconnected for rotation about the longitudinal center axis of the camshaft 24. The camshaft 24 is restrained from axial movement by a pair of integrally formed and axially spaced thrust flanges 40 and 42 which abut the opposed sides of the bearing assembly 30 and the bearing saddle 36 and are annular in configuration. In addition, the drive gear 22 is secured from axial disengagement relative to the camshaft 24 by a thrust bearing-snap ring combination 44 in which the snap ring is located in a groove formed in the front end of the camshaft 24.

The front portion of the quill shaft 28 extends through the camshaft 24 and, as mentioned above, has its front portion formed with the hub member 38. A disk-shaped portion 46 of the hub member 38 is bolted to the drive gear 22 by a plurality of circumferentially spaced bolts, two of which are only shown in FIG. 2 and identified by reference numeral 48. Each of the bolts 48 extends through a curved slot 50 formed in the circular portion of the hub member 38 so as to permit limited angular adjustment of the drive gear 22 relative to the hub member 38 upon loosening of the bolts 48.

The control assembly 16 seen in FIG. 3 is positioned at the rear of the engine 10 as seen in FIG. 1 and provides the change in timing or phasing of the camshaft 24 relative to the crankshaft 18. The control assembly 16 is attachable to the rear portion of the quill shaft 28 and the rear portion of the camshaft 24 in a manner which will be more fully explained hereinafter. When the control assembly 16 is assembled to the quill shaft 28 and the camshaft 24, it includes the rear portion of the quill shaft 28, the rear portion of the camshaft 24, a cylindrical extension member 52, a connector member 54, an axially movable sleeve member 56, a nut member 58, and a stepper motor 60. The stepper motor 60 receives input pulses from an electronic control system (not shown) and is adapted to drivingly rotate the nut member 58 through a pair of gears 62 and 64 the latter of which is formed on the inboard end of the nut member 58.

In most engines, the timing or phase relationship between a camshaft and a crankshaft is set and is not adjustable during the operation of the engine. However, various engine related operational conditions or parameters, such as speed, load, temperature, or other operative factors, are functional factors that together relate to an ideal timing or phasing of the camshaft relative to the crankshaft. The parameters or factors are sensed by various devices and inputted as signals to an electronic control unit (ECU) which then produces an appropriate desirable output control signal in the form of control pulses that can afterwards be fed to a stepper motor 60 (such as in the control assembly 16) for ideal angular phasing of the camshaft. An ECU for providing such control pulses can be seen in my aforementioned U.S. Pat. No. 5,673,659 and attention is directed to that patent for a full explanation of the manner that the stepper motor 60 of this invention receives the input pulses from an ECU.

As seen in FIG. 3, the rear portion of the camshaft 24 is supported for rotative movement by a bearing cap 66 secured by a plurality of bolts (not shown) to a bearing saddle 68 integral with the cylinder head 11 of the engine 10. A bushing 69 is located in an annular recess in the inner cylindrical surface of the camshaft 24 to allow support and concentric operation of the quill shaft 28. The rear portion of the quill shaft 28 extends through the hollow camshaft 24 and has its rear end outer surface terminating with a plurality of circumferentially and equally spaced balls 70 each of which is located in a semi-spherical cavity formed in the outer surface of the quill shaft 28. The center of each of the balls 70 is located in a plane that is normal to the longitudinal center axis of the quill shaft 28. A cylindrical pin 72, extending along the longitudinal center axis of the quill shaft 28, is fixed in the rear portion of the quill shaft 28 and serves to support the connector member 54 for axial movement along the pin 72. In this regard, it will be noted that the connector member 54 consists of a collar 74 fixed to a cylindrical sleeve by suitable fasteners (not shown). The collar 74, in the position shown in FIG. 3, abuts a snap-ring 78 located in an annular groove formed adjacent to the rear end of the pin 72. The inner surface of the cylindrical sleeve 76 is formed with a plurality of helical grooves 80 each of which accommodates one of the balls 70 supported by the quill shaft 28. Each of the helical grooves 80 is hemispherical in cross section and extends longitudinally along the inner surface of the sleeve 76. Also, the number of helical grooves 80 correspond in number to the number of balls 70.

As seen in FIG. 3, the left end of the sleeve 76 of the connector member 54 is provided with a plurality of balls 82 of a size corresponding to the size of the balls 70. As in the case of the balls 70, each of the balls 82 is circumferentially equally spaced about the outer circumference of the sleeve 76 and is located in a hemispherical cavity formed in the outer surf ace of the sleeve 76. Moreover, the center of each of the balls 82 is located a vertical plane which is parallel to the aforementioned plane passing through the balls 70. In this case, each of the balls 82 is located in one spline of a plurality of straight splines 84 formed in the inner cylindrical surface of the extension member 52. Each of the splines 84 extend parallel to the longitudinal center axis of the camshaft 24. The extension member 52 has its leftward end, as seen in FIG. 3, connected to corresponding straight splines 86 formed on the rear end portion of the camshaft 24. The extension member 52 is prevented from moving axially relative to the camshaft 24 by snap ring 88 and a ring-shaped retainer 90 as will be more fully understood as the description of the invention continues.

With further reference to FIG. 3, the rear part or back plate 91 of an outer housing 92 rigidly supports a plurality of guide pins 94 which are equally circumferentially spaced from each other and serve as guides for allowing the sleeve member 56 to move axially along the guide pins 94 from the position seen in FIG. 3 to a position adjacent the retainer 90. The longitudinal center axis of each of the guide pins 94 is parallel to the longitudinal center axis of the quill shaft 28. In this regard, the nut member 58 is cylindrical in cross section and has its inner cylindrical surface formed with a semi-circular helical groove 96 simulating a screw thread. Similarly, the sleeve member 56 is cylindrical in cross section and has a plurality of spherical balls 98 each of which is disposed in an individual hemispherical cavity formed in the outer cylindrical surface of the sleeve member 56. The hemispherical cavities of the sleeve member 56 supporting the balls 98 are located along a helical path which matches the helical groove 96 formed in the nut member 58.

It will be noted that the sleeve member 56 and the connector member 54 are held together as a unit. As a result, axial movement of the sleeve member 56 causes axial movement of the connector member 54. In this regard, the inner cylindrical surface of the sleeve member 56 is connected through a pair of snap rings 82 and 84 to a ball bearing 104 which, in turn, has its inner race mounted on the collar 74 of the connector member 54. The outer race of the ball bearing 104 is located between a shoulder 106 in the inner cylindrical surface of the sleeve member 56 and the snap ring 100. Thus, axial movement of the sleeve member 56 as guided by the pins 94 and results in axial movement of the connector member 54.

As aforementioned, the inboard end of the nut member 58 is formed with a gear 64 which meshes with the gear 62 of the step motor 60. The nut member 58 also has its inboard end supported by a ball bearing 108 that has its outer race maintained in position by a snap ring 110 located in an annular groove formed in the inner surface of the nut member 58. The inner race of the ball bearing 108 is maintained in position between a snap ring 112 located in an annular groove formed in the outer surface of the extension member 52 and a shoulder formed in the outer surface of the extension member 52. Thus, the nut member 58 is supported concentric to the longitudinal center axis of the quill shaft 28 through the bearing 108 and the extension member 52 which, in turn, is held concentric by its attachment to the camshaft 24. As should be apparent, the extension member 52 is prevented from axial movement by the snap ring 88 and the retainer member 90 which has a portion thereof abutting the outer race of the bearing 108 and another portion thereof abutting the pins 94. Likewise, the nut member 58 is also prevented from moving axially but is capable of rotative movement.

At this juncture it will be noted that one feature of the present invention is that a portion of the control assembly 16 can be readily mounted to the rear end of the camshaft 24 and the quill shaft 28 of the engine 10 through an attachment arrangement. In this regard, it will be understood that such portion of the control assembly 16 will hereinafter be referred to as the "self-contained unit" and shall consist of all of the parts of the control assembly 16 hereinbefore described except the camshaft 24 and the quill shaft 28. It will also be understood that self-contained unit is intended to be a separate assembly and pre-assembled in its entirety ready for mounting to the engine 10.

In order to mount the self-contained unit of the control assembly 16 to the cylinder head 12 and attach it to the splines 86 of the camshaft 24, the rear of the cylinder head 12 must meet certain standardized mounting requirements. These requirements include that the rear end of the camshaft 14 and the quill shaft 28 must be formed as described above and the back wall 114 of the cylinder head 112 must be machined to accept the head plate 116 of the housing 92. Quick assembly of the self-contained unit to the camshaft 14 and the quill shaft 28 is realized by first inserting the snap-ring 88 in the camshaft splines 86 to limit excessive axial inboard displacement of the unit once secured in place. Next, the connector member 54 must be properly pre-indexed relative to the rear end of the quill shaft 28 with the balls 70 assembled thereon and held with heavy grease or other means and by proper marking of the components perhaps aided by a one-engagement-only position design approach. The splines 84 and 86 on the extension member 52 and the rear end of the camshaft 28 should also be properly marked and with engagement aided by another one-engagement-only positioning scheme. When sliding the assembled self-contained unit from the rear of the engine 10, the inboard end of the extension member 52 formed with the internal straight hemispherical splines 84, engages the matching straight external splines 86 on the camshaft 24 and sliding motion is continued until the inboard end of the extension member 52 contacts the snap ring 88. At this point, the connector member 54 must be pre-positioned forward enough (by the proper pre-arranged rotation of the shifting sleeve member 56) so that the collar portion 74 of the connector member 54 clears the annular groove in the pin 72 normally accommodating the snap ring 102 to allow insertion of such snap ring 102 therein. Once the self-contained unit is attached in place with the camshaft 24 and the quill shaft 28, the housing 92 and together with the step motor 60 are secured to the cylinder head back wall 114 by a plurality of threaded fasteners two of which are only shown and identified by the reference numerals 117 and 118. The rear cover plate 91 together with the pins 94 secured thereto are held in place by a plurality of threaded fasteners two of which are only shown and identified by the reference numeral 119. In this manner, this simple procedure completes the installation of the unit in place relative to the camshaft 24 and the quill shaft 28.

Once the camshaft drive device composed of the timing drive assembly 14 and the control assembly 16 are assembled and made a part of the engine 10 as seen in FIGS. 1–3, the camshaft drive device operates as follows: When the stepper motor 60 receives an input signal and pulses from the ECU calling for a phase change of the camshaft 24, the gear 62 will be drivingly rotated a predetermined amount and in a direction as dictated by the input signal and pulses. The rotation of the gear 62 will cause corresponding rotation of the nut member 58 through the gear 64. As the nut member 58 rotates about the sleeve member 56, the helical groove 96 acts through the encapsulated balls 98 to cause the sleeve member 56, together with the connector member 54, to move axially along the guide pins 72 and 94. At the same time that the connector member 54 moves axially it also will rotate a predetermine amount as dictated by the action of the stepper motor 60. The rotation of the connector member 54 relative to the quill shaft 28 occurs due to the helical splines 80 of the connector member 54 moving axially along the balls 70 encapsulated in the end of the quill shaft 28. Inasmuch as the connector member 54 is connected to the extension member 52 by the balls 82 and the straight splines 84 in the inner surface of the extension member 52, the rotative movement of the connector member 54 is transmitted to the extension member 52 and finally to the camshaft 24 through the connection provided between the camshaft 24 and the extension member by the splines 84 and 86. This results in a rotation of the camshaft 24 relative to the drive gear 22 of the timing drive assembly 14. This occurs due to the fact that the quill shaft 28 is restricted from any rotative movement by the fixed connection with the drive gear 22 of the drive assembly 14. Thus, in this manner, a phase change in the operation of the valves of the engine 10 occurs by the angular repositioning of the camshaft 24 relative to the position of the drive gear 22.

It should be noted that the sleeve member 56 connected to the nut member 58 through the helical groove 96 and the balls 98 constitutes a ball-nut transmission of the type shown in my co-pending patent application Ser. No. 09/271,229, entitled "BALL-NUT TRANSMISSION, filed on Mar. 17,1999, and assigned to the assignee of this invention. Inasmuch as the balls 98 are located in hemispherical cavities and encapsulated between the individual cavity supporting each ball 98 and the helical groove 96 in the nut member 58, this ball-nut transmission provides an efficient linear movement of the sleeve member 56 with a minimum of friction and without the need for a return-duct for the balls as found in the conventional ball-nut-screw devices. As similar efficient ball-nut transmission arrangement is provided by the interconnection between the helical splines 80 of the connector member 54 and the balls 70.

Figure 4:
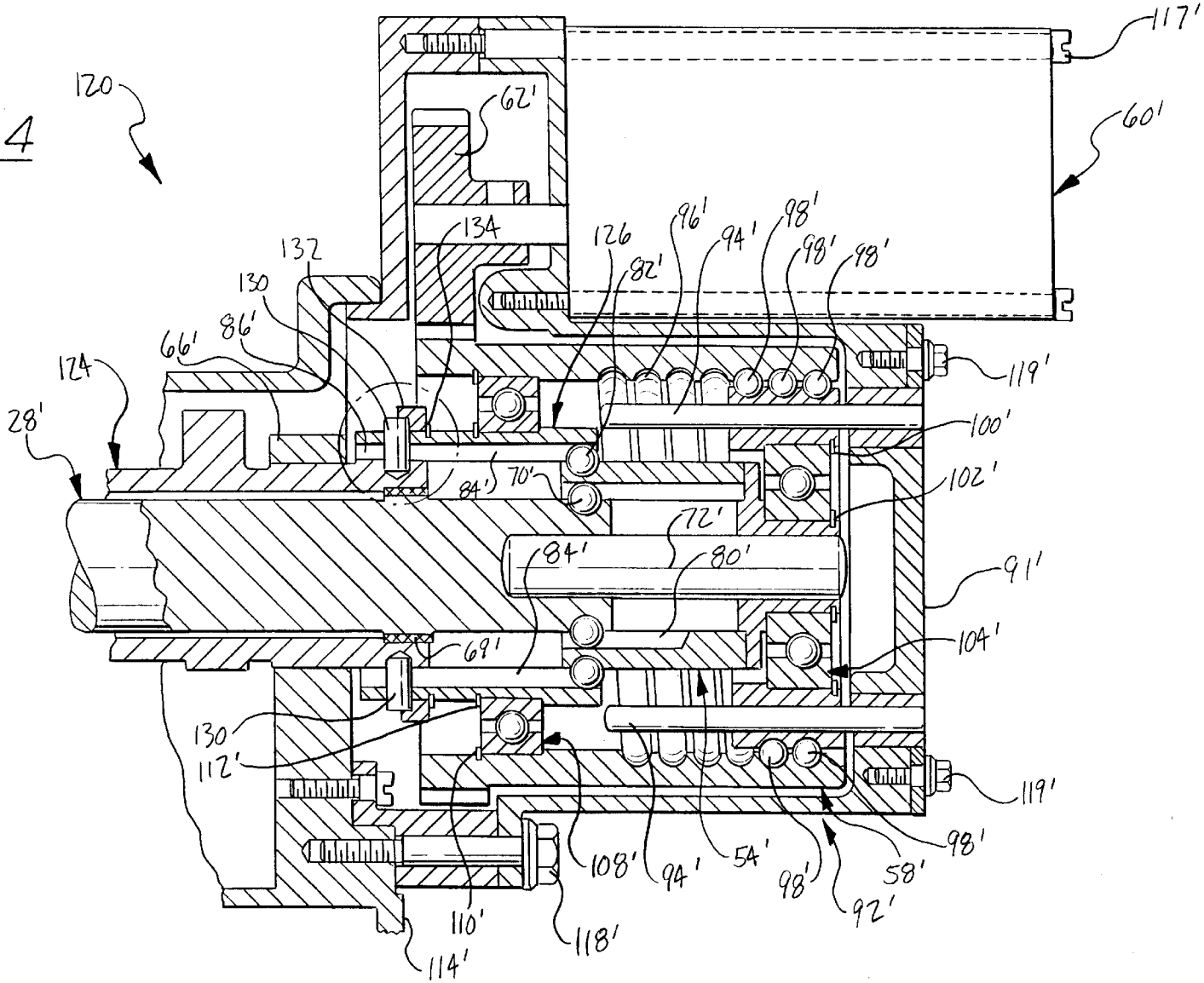
FIG. 4 is a cross-sectional view showing the internal parts of an alternate control assembly having a unique quick action snap-on arrangement for mounting the control assembly to the cylinder head of the internal combustion engine seen in FIG. 1.

FIG. 4 shows another embodiment of a control assembly 120 that provides a different interconnection, namely a snap-action connection, between the extension member and the camshaft for facilitating the mounting of a self-contained unit (as described above) to the outboard ends of the camshaft and the quill shaft. In this regard, it should be noted that the parts shown in FIG. 4 that are identical to the parts shown in FIG. 3 are identified by identical reference numerals but primed.

Figure 6:
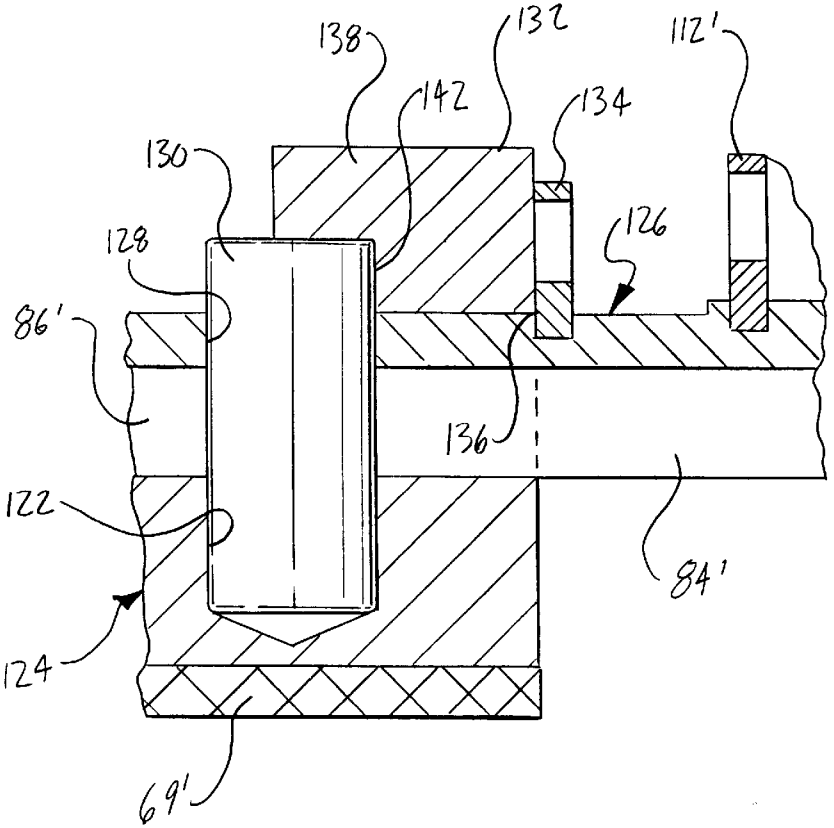
FIG. 6 is a view similar to that seen in FIG. 5 showing the parts of the snap-on arrangement after connection with the camshaft of the engine.
Figure 5:
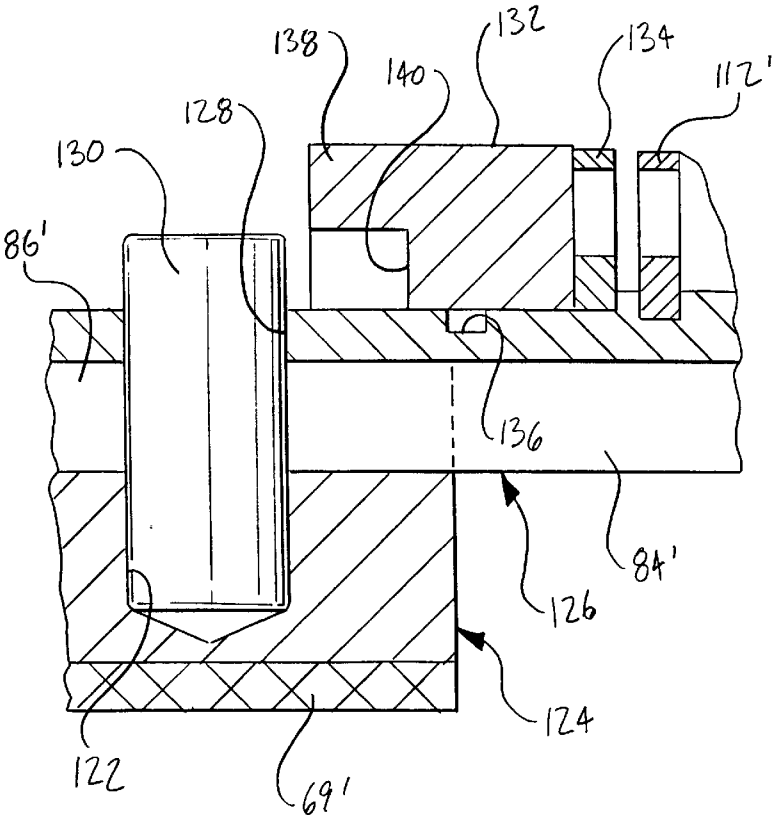
FIG. 5 is an enlarged view of the circled area in FIG. 4 showing the position of the parts of the snap-on arrangement prior to the connection with the camshaft of the engine.

The main difference between the control assembly 120 and the control assembly 16 is that the rear of the camshaft 124 is not only formed with straight hemispherical splines 86' but, in addition, is provided with a plurality of cylindrical holes 122 as best seen in FIGS. 5 and 6. The holes 122 are circumferentially equally spaced about the outer diameter of the rear end of the camshaft 124 and each of their longitudinal center axes is located in a plane normal to the longitudinal center axis of the camshaft 124. Moreover, each of the longitudinal axes of the holes 122, when extended radially inwardly, intersect the longitudinal center axis of the camshaft 124.

In addition, the inboard end of the extension member, identified by the reference numeral 126 in FIGS. 4–6, is provided with radially extending cylindrical holes 128 that correspond in number and size to the holes 122 formed in the camshaft. The holes 122 register with the corresponding holes 128 and each registering pair of holes 122 and 128 is provided with a cylindrical pin 130 which serves to retain the extension member 126 in fixed relationship with the camshaft 124. As seen in FIG. 6, a locking collar 132, which is maintained in position by a snap ring 134 located in an annular groove 136 in the outer surface of the extension member 126, contacts the outer end of each of the pins 130 and serves to hold the pins 130 in the position seen. In this manner, the extension member 126 is fixed to the extension member 126 and the retainer ring 90 as provided in the control assembly 16 is no longer required for maintaining the extension member 26 in fixed relationship with the rear end of the camshaft 124.

With this modified arrangement, quick assembly of the self-contained unit of the control assembly 120 to the extension member 126 and the quill shaft 28' is achieved initially by proper pre-indexing of the connector member 54' relative to the rear end of the quill shaft 28'. During this time and as in the case of the assembly of the self-contained unit of the control assembly 16, the balls 70 and 82 would be respectively maintained in their accommodating cavities in the quill shaft 28' and the connector member 54' by heavy grease or other means. While sliding the self-contained unit from the rear of the engine, the outboard end of the guide pin 72' enters the accommodating opening in the collar 74' of the connector member 54' followed by the rear end of the splines 84' on the extension member 126 engaging the matching splines 86' formed on the rear end of the camshaft 124. The extension member 126 is slid over the splines 86' without having the pins 130 mounted therein. For this operation, it would be best to position the aligned holes 122 and 128 on the extension member 126 and the camshaft 124 so that they are disposed at 90 degrees from the position shown to facilitate the introduction of the pins 130 in their radially disposed holes. Referring now to FIG. 5, once the pins 130 are introduced in their respective holes 122 and 128, the pre-mounted locking collar 132 and snap ring 134 are slid forward until the front end 138 of the collar 132 covers the outer end of the pins 130 and an inner wall 140 of the collar 132 contacts the rear side 142 of the pins 130 as seen in FIG.6. At this point, the collar 132 will clear the annular groove 136 and allow the snap ring to be located therein with a "snap action" and assume the position seen in FIGS. 4 and 6 so as to securely hold the extension member 126 in place on the rear end of the camshaft 124. Thus, it can be appreciated how the complete self-contained unit, which can be manufactured and assembled at low cost away from the engine's final assembly line, can be installed and secured in place in a relatively simple manner.

Once the self-contained unit is attached in place with the camshaft 124 and the quill shaft 28', the housing 92' together with the step motor 60' are secured to the cylinder head back wall 114' by a plurality of threaded fasteners two of which are only shown and identified by the reference numerals 117' and 118'. The rear cover plate 91' together with the pins 94' secured thereto are held in place by a plurality of threaded fasteners two of which are only shown and identified by the reference numeral 119'.

As should be apparent, the operation of the camshaft drive device and particularly the control assembly 120 as seem in FIG. 4, is the same as explained in connection with the control assembly 16 for providing a varying timing of the opening and closing of the intake and/or exhaust valves with respect to the phase of the piston stroke. For this reason, the operation will not be repeated here.

Various changes and modifications can be made in the camshaft phase controlling devices described above without departing from the spirit of the invention. Such changes and modifications are contemplated by the inventor and he does not wish to be limited except by the scope of the appended claims.

What is claimed is:

1. A camshaft drive device for an internal combustion engine having a crankshaft, said camshaft drive device comprising a timing drive assembly located at one end of said engine and a control assembly located at the other end of said engine, said timing drive assembly having a drive gear adapted to be driven by said crankshaft of said engine, a hollow camshaft extending between said timing drive assembly and said control assembly, a quill shaft coaxially mounted within said hollow camshaft and having a first portion located at said one end of said engine and being connected to said drive gear, said quill shaft having a second portion located at said other end of said engine and being formed with a plurality of hemispherical cavities located in a plane extending transversely to the longitudinal axis of said quill shaft, a ball located in each of said hemispherical cavities of said quill shaft, said hollow camshaft being rigidly connected to a cylindrical extension encircling said second portion of said quill shaft and having its inner cylindrical surface formed with straight splines extending along the longitudinal axis of said hollow camshaft, an axially movable sleeve member being connected with a cylindrical connector member located between said balls of said quill shaft and said straight splines, said cylindrical connector member having the outer surface thereof supporting a plurality of circumferentially spaced balls which mate with said straight splines of said cylindrical extension and having the inner surface thereof formed with helical splines which mate with the balls of said quill shaft, a nut member surrounding said sleeve member and being drivingly connected to said sleeve member through a plurality of circumferentially spaced non-recirculating balls encapsulated in said sleeve member and located in a helical groove formed in said nut member so that, upon rotation of said nut member, said sleeve member and said cylindrical connector member are moved axially to cause said helical splines of said cylindrical connector member and through said straight splines of said cylindrical extension to provide a phase change of said camshaft relative to said drive gear.

2. A camshaft drive device for an internal combustion engine having a crankshaft, said camshaft drive device comprising a timing drive assembly located at one end of said engine and a control assembly located at the other end of said engine, said timing drive assembly having a drive gear adapted to be driven by the crankshaft of said engine, a hollow camshaft extending between said timing drive assembly and said control assembly, a quill shaft co-axially mounted within said hollow camshaft and having a first portion located at said one end of said engine and being connected to said drive gear through an adjustable connection, said quill shaft having a second portion located at said other end of said engine and being formed with a plurality of hemispherical cavities located in a plane extending transversely to the longitudinal axis of said quill shaft, a ball seated in each of said hemispherical cavities of said quill shaft, said hollow camshaft being rigidly connected to a cylindrical extension encircling said second portion of said quill shaft and having its inner cylindrical surface formed with straight extending along the longitudinal axis of said hollow camshaft, a sleeve member, a cylindrical connector member connected to said sleeve member and having a portion thereof located between said balls of said quill shaft and said straight splines, a guide pin secured to said second portion of said quill shaft for supporting said connector member for axial movement relative to said quill shaft, said cylindrical connector member having the outer cylindrical surface thereof supporting a plurality of circumferentially spaced balls which mate with said straight splines of said cylindrical extension and having the inner cylindrical surface thereof formed with helical splines which mate with said balls of said quill shaft, a nut member surrounding said sleeve member and being drivingly connected to said sleeve member through a plurality of circumferentially spaced non-recirculating balls encapsulated in said sleeve member and located in a helical groove formed in said nut member so that, upon rotation of said nut member, said sleeve member and said cylindrical connector member are moved axially to simultaneously cause said helical splines of said cylindrical connector member to move along the stationary balls of said quill shaft and cause the balls supported by the cylindrical connector member to move along said straight splines of said cylindrical extension to provide a phase change of said camshaft relative to said drive gear.

3. The camshaft drive device of claim 2 wherein said straight splines and said helical splines are hemispherical in cross sections.

4. The camshaft drive device of claim 3 wherein said cylindrical extension is connected to said camshaft by said straight splines.

5. The camshaft drive device of claim 2 wherein an electric stepper motor forms a part of said control assembly for rotating said nut member and causing axial movement of said sleeve member and said connector member.

6. The camshaft drive device of claim 2 wherein said sleeve member is connected to said connector member through a bearing means which allows rotative movement of said connector member.

7. The camshaft drive device of claim 2 wherein said extension member is connected to said camshaft by a plurality of radially extending cylindrical pins and wherein said cylindrical pins are held in position by a ring member.

8. The camshaft drive device of claim 2 wherein said device includes a outer housing and provided with means for preventing rotative movement of said sleeve member.

9. The camshaft drive device of claim 2 wherein said first portion of said quill shaft is integrally formed with a hub member which is connected to said drive gear through said adjustable connection.

10. The camshaft drive device of claim 9 wherein said hub member is formed with a plurality of arcuate slots through each of which extends a bolt for providing said adjustable connection.

11. The camshaft drive device of claim 5 wherein the outer circumference of said nut member is formed with gear teeth which mesh with the gear teeth of a pinion driven by said stepper motor.

12. The camshaft drive device of claim 11 wherein bearing means are located between said nut member and said cylindrical extension.

13. A camshaft drive device for an internal combustion engine having a crankshaft, said camshaft drive device comprising a timing drive assembly located at one end of said engine and a control assembly located at the other end of said engine, said timing drive assembly having a drive gear adapted to be driven by the crankshaft of said engine, a hollow camshaft extending between said timing drive assembly and said control assembly, a quill shaft co-axially mounted within said hollow camshaft and having a first portion located at said one end of said engine and being connected to said drive gear through an adjustable connection, said quill shaft having a second portion located at said other end of said engine and being formed with a plurality of hemispherical cavities located in a plane extending transversely to the longitudinal axis of said quill shaft, a ball located in each of said hemispherical cavities of said quill shaft, a cylindrical extension encircling said second portion of said quill shaft and being connected to said camshaft, a plurality of straight splines formed on the inner surface of said cylindrical extension, an axially movable sleeve member, a cylindrical connector member connected to said sleeve member for axial movement therewith and having a portion thereof located between said straight splines and said balls mounted on said quill shaft, said portion of said cylindrical connector member having helical splines receiving said balls on said quill shaft and supporting a plurality of balls that mate with said straight splines of said cylindrical extension, bearing means interposed between said sleeve member and said connector member so as to allow rotative movement of said connector member relative to said sleeve member, and a nut member surrounding said sleeve member and being drivingly connected to said sleeve member through a plurality of circumferentially spaced non-recirculating balls each of which is encapsulated between a hemispherical cavity formed in said sleeve member and a helical groove formed in said nut member so that, upon rotation of said nut member, said sleeve member and said cylindrical connector member are moved axially to cause said helical splines of said connector member to move along said balls of said quill shaft and cause rotative movement of said connector member and through said straight splines of said cylindrical extension to angularly rotate said camshaft and provide a phase change of said camshaft relative to said drive gear, and an electric stepper motor forming a part of said control assembly for rotating said nut member and causing axial movement of said sleeve member and said connector member.

* * * * *